US007571912B2

(12) United States Patent
Larson et al.

(10) Patent No.: US 7,571,912 B2
(45) **Date of Patent: *Aug. 11, 2009**

(54) BULLET TRAPPING MEDIUM, SYSTEM FOR EMPLOYING SAID MEDIUM AND METHOD OF USE OF SAID MEDIUM

(75) Inventors: Steven L. Larson, Vicksburg, MS (US); Charles A. Weiss, Clinton, MS (US); Joe G. Tom, Vicksburg, MS (US); Philip G. Malone, Vicksburg, MS (US); Edward J. Fransen, Irvine, CA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 754 days.

This patent is subject to a terminal disclaimer.

(21) Appl. No.: 10/979,834

(22) Filed: Nov. 3, 2004

(65) Prior Publication Data

US 2005/0093243 A1 May 5, 2005

Related U.S. Application Data

(63) Continuation of application No. 10/307,427, filed on Dec. 2, 2002, now Pat. No. 6,837,496.

(51) Int. Cl.
*F41J 1/12* (2006.01)

(52) U.S. Cl. ..... 273/410

(58) Field of Classification Search ..... 273/403–410; 89/36.02; 528/484; 442/409; 106/672; 428/306.6
See application file for complete search history.

(56) References Cited

U.S. PATENT DOCUMENTS 5,435,571 A 7/1995 Wojcinski et al.
5,607,163 A 3/1997 Nesler
5,848,794 A 12/1998 Wojcinski et al.
5,901,960 A 5/1999 Nesler et al.
6,000,700 A 12/1999 Nesler et al.
6,027,120 A 2/2000 Wojcinski et al.
6,173,956 B1 1/2001 O'Neal
6,264,735 B1 7/2001 Bean et al.
6,293,552 B1 9/2001 Wojcinski et al.
6,378,870 B1 4/2002 Sovine
6,446,974 B1 9/2002 Malone et al.

(Continued)

FOREIGN PATENT DOCUMENTS

WO WO 91/17408 11/1991

*Primary Examiner*—Mark S Graham
(74) *Attorney, Agent, or Firm*—Earl H. Baugher, Jr.; Nicholas Landau; Scott Feilder

(57) ABSTRACT

A stable fire retardant mixture for use in a backstop for decelerating and trapping projectiles. The backstop generally includes a support structure having an inclined surface and the stable fire retardant mixture serving as a projectile trapping medium disposed on the inclined surface. The projectile trapping medium is a resilient granular material intimately mixed with a hydrated super absorbent polymer (SAP) gel and additives. Preferably, the support structure is made of a shock absorbing, foamed, fiber-reinforced concrete, such as SACON®. In embodiments, the support structure also includes an enclosure. The additives control alkalinity, chemically stabilize the mixture, prolong life of the mixture, retard mold formation and bacterial growth and prevent leaching of heavy metals.

29 Claims, 4 Drawing Sheets

U.S. PATENT DOCUMENTS 6,562,743 B1 * 5/2003 Cook et al. ..... 442/409
6,573,358 B2 6/2003 Michels et al.
6,620,236 B2 9/2003 Huntsman et al.
6,688,811 B2 2/2004 Forrester
6,837,496 B2 * 1/2005 Larson et al. ..... 273/410
2003/0186043 A1 * 10/2003 Koslow ..... 428/306.6
2004/0104533 A1 6/2004 Larson et al.

* cited by examiner

BULLET TRAPPING MEDIUM, SYSTEM FOR EMPLOYING SAID MEDIUM AND METHOD OF USE OF SAID MEDIUM

This application is a continuation of application Ser. No. 10/307,427, filed Dec. 2, 2002 now U.S. Pat. No. 6,837,496.

STATEMENT OF GOVERNMENT INTEREST

Under paragraph 1(a) of Executive Order 10096, the conditions under which this invention was made entitle the Government of the United States, as represented by the Secretary of the Army, to an undivided interest therein on any patent granted thereon by the United States. This and related patents are available for licensing to qualified licensees. Please contact Phillip Stewart at 601 634-4113.

BACKGROUND OF THE INVENTION

1. Field of the Invention

The present invention relates generally to a resilient mixture used in a bullet trap and method for employing same.

2. Background Description

In order to maintain proficiency in the use of firearms, it is common to engage in target practice on a training range. Traditionally, the primary concern on a training range was the prevention of ricochets. Thus, ranges often use a large dirt berm behind the target to decelerate and trap the bullet.

More recently, however, considerable concern has been raised about the environmental impact of heavy metals (e.g., lead, tungsten, copper) contained within the bullet. Though a bullet fired into a mound of dirt is safely contained from the standpoint of no longer being a dangerous projectile, heavy metals within the bullet remain free to leach into the soil, thereby contaminating the environment. Thus, shooting ranges have begun to stress containment and removal of expended rounds in order to prevent environmental contamination.

Additionally, there is a growing desire to build shooting ranges within enclosed structures. This permits frequent use of the range regardless of weather and without excessive travel time. Obviously, however, use of a dirt berm behind the target is impractical for such indoor ranges.

Thus, current trends in bullet containment systems focus on two different types of systems. The first, often called a bullet stop and containment chamber, has a pair of plates that channel bullets toward an opening in a containment chamber. Inside the containment chamber are impact plates that slow the bullet to a stop. Unfortunately, such systems are relatively expensive and difficult to manufacture and maintain.

The second type of containment system is the bullet backstop or bullet trap system. Bullet backstops typically include a back plate made of steel inclined to the line of fire. On an upper surface of the back plate, a layer of material is disposed to provide a medium for decelerating and trapping bullets. This layer is several feet thick in the direction the bullet travels. The impact material is typically a resilient granular material. As a bullet impacts the material, it will decelerate sufficiently such that, if it does impact the back plate, any ricochet will be minimal.

A number of bullet traps utilize rubber chunks or chips as the impact material. For example, U.S. Pat. No. 6,378,870 to Sovine ("the '870 patent") teaches the use of relatively large rubber nuggets disposed along a plane inclined to the line of fire, while U.S. Pat. No. 5,848,794 to Wojcinski et al. ("the '794 patent") discloses a similar bullet trap using relatively small rubber granules disposed along an inclined plane. To reduce scatter and sluffing of the impact material, the '794 patent further teaches the use of a self-healing membrane covering the rubber granules.

However, trapping systems like those disclosed in the '870 patent and the '794 patent lack inherent fire retardant characteristics. Thus, they often suffer from heat and fire problems, especially if the chips are not treated with a fire retardant, are improperly maintained, contain steel or fiber, or if the chips are relatively small. To combat these hazards, both the '870 patent and the '974 patent teach treating the rubber nuggets with a fire retardant. Unfortunately, the fire retardants used in these and other prior art systems tend to wash off, such that traps maintained outdoors will rapidly lose their fire retardant characteristics during and after a rain. Additionally, though these systems trap the bullet, they do nothing to stabilize them from an environmental hazard standpoint. Thus, expended rounds must periodically be recovered from the trap to prevent heavy metal leaching and associated environmental contamination.

SUMMARY OF THE INVENTION

Accordingly, it is an object of the present invention to provide a bullet trapping system with inherent flame retardant characteristics.

It is another object of the present invention to provide a bullet trapping system that substantially reduces the likelihood of ricochets.

Still another object of the present invention is to provide a bullet trapping system that will not leach heavy metals into the environment.

Yet another object of the present invention is to provide a bullet trapping system that can accommodate many different calibers and types of bullets.

A further object of the present invention is to provide a bullet trapping system that requires minimal maintenance over an extended useful life.

Select embodiments of the present invention provide a stable fire retardant mixture for use as a projectile or bullet trapping medium in a backstop for decelerating and trapping projectiles. The backstop generally includes a support structure having an inclined surface and a stable fire retardant mixture disposed on the inclined surface. The stable fire retardant mixture comprises a resilient granular medium, such as rubber chunks, plastic scrap, or wood chips intimately mixed with a hydrated super absorbent polymer (SAP) gel and additives for improving performance of the stable fire retardant mixture. Preferably, the support structure is made of a shock absorbing, foamed, fiber-reinforced concrete, such as SACON®. In embodiments, the support structure also includes an enclosure. The enclosure includes a back wall and opposing sidewalls, and optionally includes a toe block adjacent to the foot of the inclined surface. Additives, such as phosphates, carbonates, silicates, bicarbonates, and hydroxides may also be included in the stable fire retardant mixture. These additives may serve to raise the pH of the SAP gel, prevent leaching of heavy metals from the projectile into the environment, stabilize the SAP gel chemically, act as a flame retardant, retard the growth of mold or bacteria in the SAP gel, or some combination thereof.

Further advantages of the present invention will be apparent from the description below with reference to the accompanying drawings, in which like numbers indicate like elements.

DETAILED DESCRIPTION OF PREFERRED EMBODIMENTS OF THE INVENTION

Figure 1:
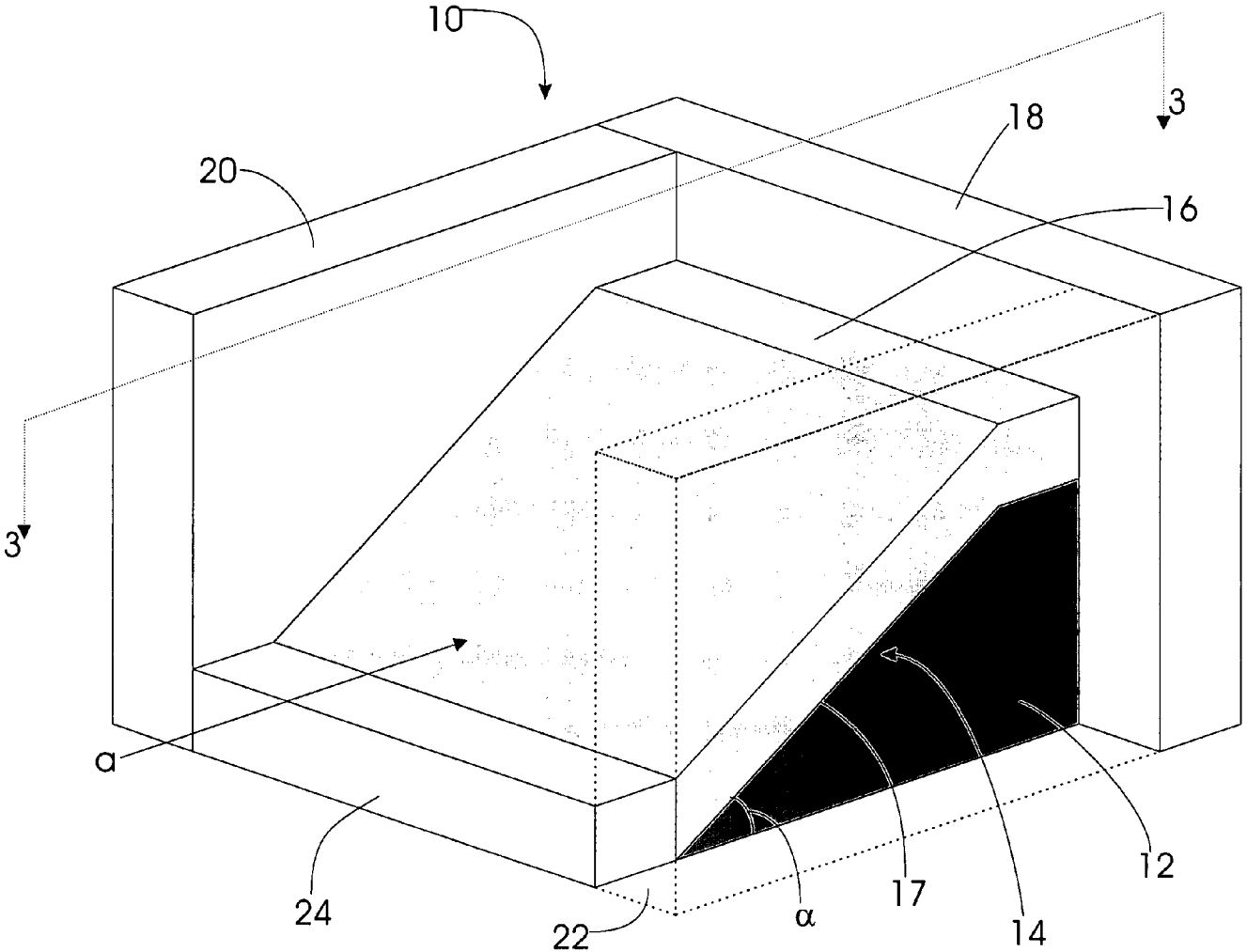
FIG. 1 is a perspective view of a bullet trapping backstop according to the present invention, with one sidewall shown in phantom for clarity.
Figure 2:
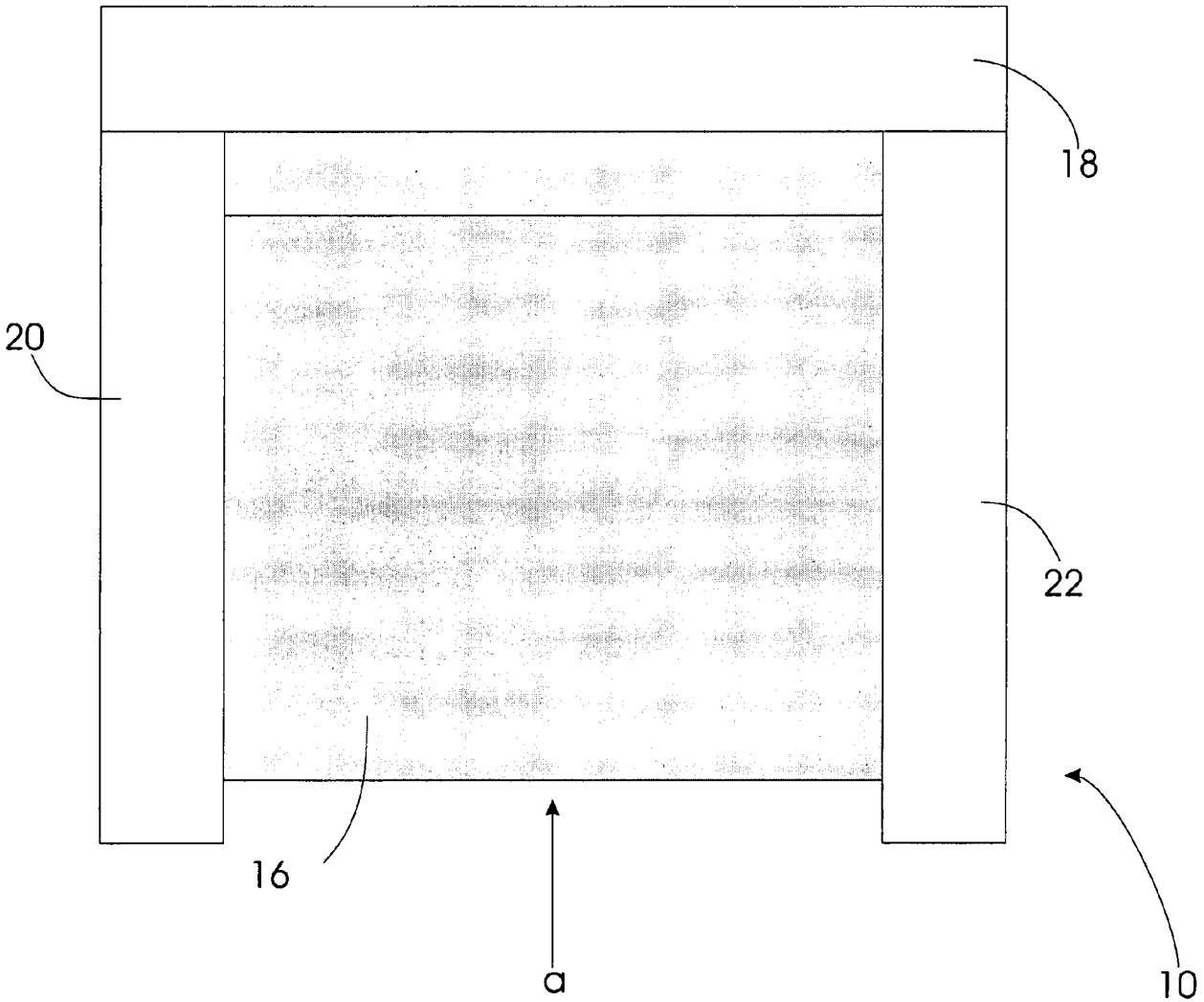
FIG. 2 is a partial top plan view of the bullet trapping backstop of FIG. 1.
Figure 3:
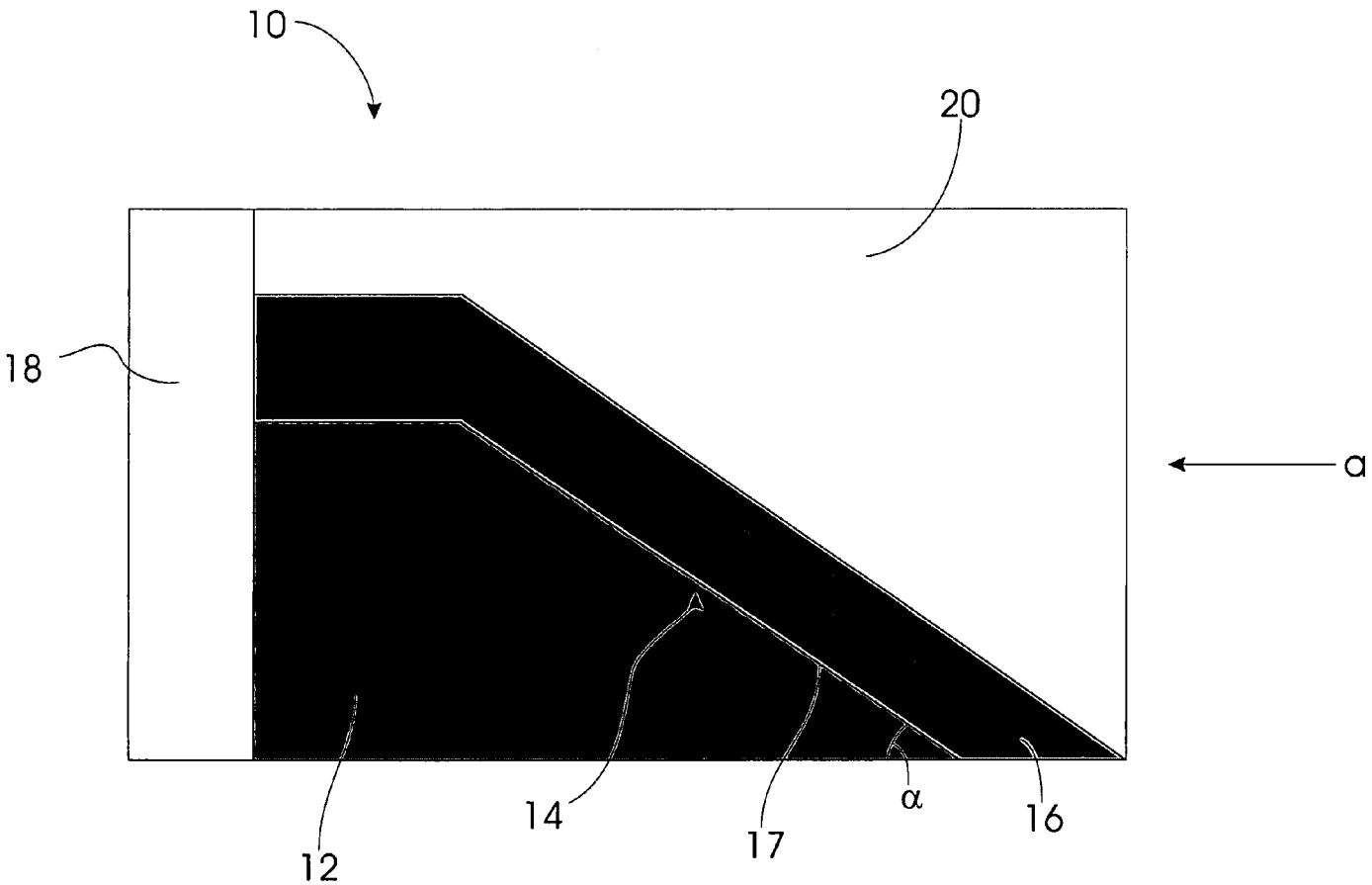
FIG. 3 is a cross-sectional side view of the bullet trapping backstop of FIG. 1, taken along line 3-3 with the optional toe block removed.

Referring now to the drawings, and specifically to FIGS. 1 through 3, there is shown a bullet trapping backstop 10 for decelerating and trapping projectiles traveling along a line of fire "a" towards backstop 10. (It should be understood that the terms "bullet," "projectile," and "round" are used interchangeably herein and refer to projectiles or munitions of any sort or caliber.) Backstop 10 generally includes a foundation or support structure 12 having an upper surface 14 and a projectile trapping medium 16 disposed on upper surface 14. FIG. 2 shows a plan view of upper surface 14 of bullet trapping backstop 10. At least a portion 17 of upper surface 14 is inclined with respect to line of fire "a" by an angle $\alpha$, which is preferably less than or equal to the angle of repose of projectile trapping medium 16. In embodiments, support structure 12 includes a back wall 18 and opposing first and second sidewalls 20, 22, forming an enclosure around projectile trapping medium 16. (In FIG. 1, second sidewall 22 is shown in phantom for clarity.) Support structure 12 may also include a toe block 24 disposed adjacent to the foot of the inclined portion 17 of upper surface 14. However, one skilled in the art will realize that, because angle $\alpha$ should not exceed the angle of repose of bullet trapping medium 16, toe block 24 is not required to hold bullet trapping medium 16 in place. This embodiment of backstop 10 is best illustrated in FIG. 3.

Preferably, support structure 12 (including back wall 18, first and second sidewalls 20, 22, and toe block 24 when present) is made of a shock absorbing, foamed, fiber-reinforced concrete, such as SACON®. Such construction reduces the likelihood of dangerous ricochets of any rounds that impact support structure 12 instead of bullet trapping medium 16. However, one skilled in the art will recognize that all or part of support structure 12 may also be made from any other appropriate material, such as wood, steel, or earth.

Figure 4:
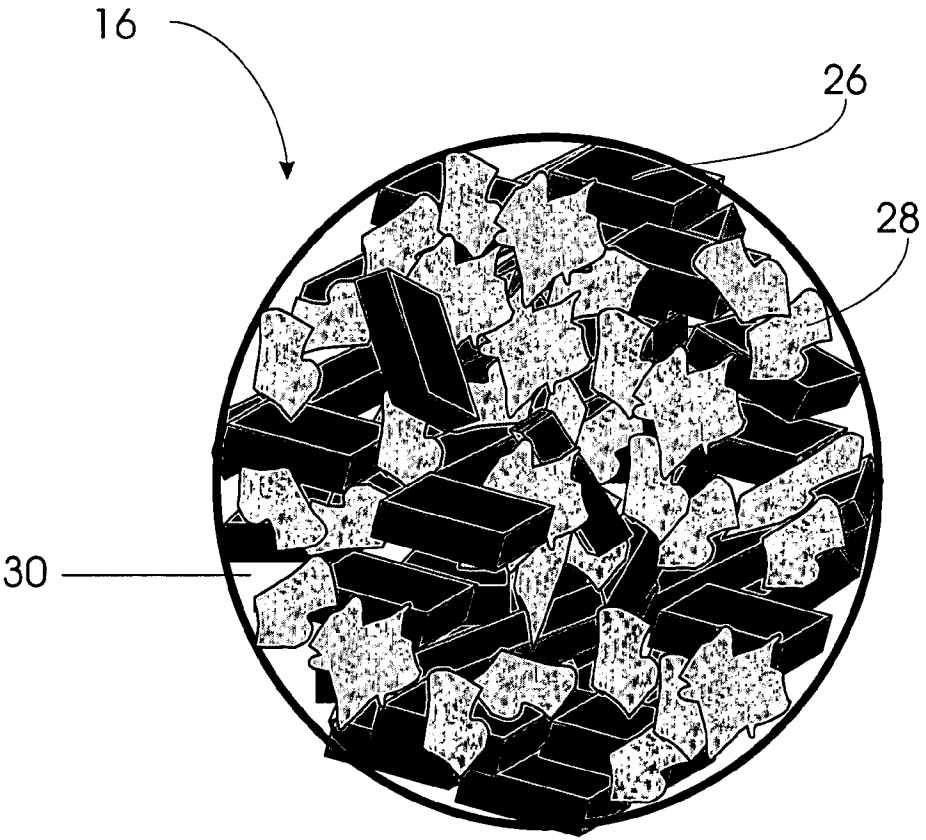
FIG. 4 is a detail view of pieces of resilient material intimately mixed with hydrated super absorbent polymer (SAP) gel.

Referring now to FIG. 4, bullet trapping medium 16 includes a resilient granular material 26, such as rubber chunks, wood chips, plastic scrap, or any other material that will not produce a ricochet when impacted by a bullet. Rubber chunks are preferred because of their durability when subjected to impacts from incoming bullets.

In embodiments, resilient material 26 is preferably mixed with a hydrated super absorbent polymer (SAP) gel 28 to form a mixture, an "artificial soil" of resilient material 26 "chunks" and SAP gel 28. That is, resilient material 26 serves as a framework to hold hydrated SAP gel 28, and hydrated SAP gel 28 occupies interstices 30 within resilient material 26. This combination provides for a higher angle of repose a (shown in FIGS. 1 and 2), a reduced likelihood of sloughing of bullet trapping medium 16, and therefore the potential for a more compact backstop 10 in the direction of line of fire "a."

SAP will absorb up to 400 times its mass in water, such that the resulting hydrated SAP gel 28 can be up to 97.5% water by mass, with nearly the density of water. Thus, for bullet trapping backstops 10 maintained outside, rainfall enhances, rather than impairs, performance. SAP material is marketed in a variety of forms (e.g., granules, powders, and fibers). Preferably, hydrated SAP gel 28 is a sodium or potassium acrylate, acrylamide, or carboxylate polymer, or some combination thereof. Further, the mixture of resilient material 26 and SAP gel 28 may be more than 50% SAP by volume, such that there is a substantially reduced likelihood of fire, thereby reducing or eliminating the need for flame retardant additives.

Cross-linked polyacrylate and polyamide SAP gels 28 are most stable when maintained in a wet condition with a pH above 4.5, as they tend to shrink and shed water in acids. Additionally, higher alkalinities reduce the solubility of lead and other heavy metal ions. Thus, in embodiments, at least one additive is mixed with hydrated SAP gel 28 to maintain a pH of at least 4.5, and preferably a pH between 8 and 12, inclusive. The most preferred additives, as discussed below, typically provide a pH of approximately 10.4.

Further, SAP gel has an inherent ability to bind lead. For example, Cetco, Inc. of Arlington Heights, Ill. claims that a granular cross-linked polyacrylate will absorb a 30 ppm lead solution, producing a volume change of 110 times the volume of the absorbent. Since most of the lead in bullet backstop 10 will be in the form of metallic lead, however, it is also desirable to include at least one additive that will form a passive coating on the metallic particles, thereby preventing the lead from corroding, formulating soluble lead compounds, and leaching into the environment.

The preferred additives generally have low solubility in water, and will typically remain as powdery solids in the mixture. Appropriate choices are phosphates, carbonates, hydroxides, silicates, and bicarbonates, either singly or in combination. These additives can serve both purposes discussed above. That is, they will both increase the pH of SAP gel 28 and prevent leaching of heavy metals into the environment. They can also help stabilize hydrated SAP gel 28 chemically, retard the growth of mold or bacteria in hydrated SAP gel 28, and enhance the flame retardant characteristics of bullet trapping medium 16. One skilled in the art will understand how to select an appropriate cation, such as potassium, sodium, aluminum, magnesium, or calcium, for the additive. It will also be apparent to one skilled in the art that different or additional additives may be used as well. However, as will be discussed below, the most preferred additives are calcium phosphate, calcium carbonate, and aluminum hydroxide.

The use of buffering and passivating additives with SAP presents additional considerations. SAP absorbs less water per unit dry weight when the water around it contains large quantities of dissolved materials. For example, a typical SAP will absorb approximately 50 times its dry weight in water in a 1% NaCl solution, but only 22 times its dry weight in a 10% NaCl solution. Most buffering and passivating compounds are most effective when they are in solution in reasonably constant concentrations. Additionally, soluble forms of phosphorus can leach out of the SAP mixture, causing environmental pollution. Furthermore, any phosphate precipitated as lead or copper phosphate is no longer available to act as a buffer.

The present invention preferably addresses these considerations by using calcium phosphate compounds having low solubilities as additives. The concentration of these calcium compounds in solution is never high enough to alter the water absorbance of the SAP. However, as the phosphate is removed by reactions with lead and copper, more solid (particulate) calcium phosphate dissolves to maintain a saturated, but not very concentrated, solution. In addition to calcium phosphate compounds, calcium carbonate and aluminum hydroxide are valuable additives. Calcium carbonate provides additional buffering capacity, while aluminum hydroxide adds to the buffering capacity and can also react with lead phosphates to form very insoluble lead aluminum phosphates.

It will be apparent to one skilled in the art how to produce an SAP mixture with a pH in the desired range and saturated with respect to the additives used. One useful method of designing build trapping medium 16 is to estimate the volume of ballistic medium 26 to be employed in backstop 10 and determine the proportion of interstices 30 in that volume. Typically, this would be approximately 50% of the volume of ballistic medium 26. Assume that the density of hydrated SAP gel 28 needed to fill interstices 30 will approximate that of water and calculate the weight of hydrated SAP gel 28. Each additive can then be added to the resilient material 26 or SAP gel 28, or a mixture of both, as 5 to 10 parts of each additive for every 100 parts of hydrated SAP gel 28.

The resulting bullet tapping medium 16 reduces the leaching of heavy metals, thus prolonging the life of the trap. Since the trapped rounds are stabilized from an environmental perspective, there is also a substantially reduced need to periodically "clean" the trap and reclaim spent rounds. Furthermore, the bullet trapping medium 16 is adapted for use with various calibers and metals, and provides for a nearly noiseless bullet impact. The bullet trapping medium 16 may also be used to anchor disposable papier-mâché or cardboard targets, thus providing a stable and transportable target display without the use of items that will produce a ricochet or require retrieval and removal.

While the invention has been described in terms of its preferred embodiments, those skilled in the art will recognize that the invention can be practiced with modifications within the spirit and scope of the appended claims. Thus, it is intended that all matter contained in the foregoing description or shown in the accompanying drawings shall be interpreted as illustrative rather than limiting, and the invention should be defined only in accordance with the following claims and their equivalents.

What is claimed is:

1. A stable fire retardant mixture for decelerating and trapping projectiles comprising at least in part heavy metals, said mixture at least reducing leaching of said heavy metals, said mixture at least comprising:

a resilient granular material;

a hydrated super absorbent polymer (SAP) gel, wherein said hydrated SAP gel is intimately mixed with said resilient granular material to yield a first interim mixture, and wherein said hydrated SAP gel adheres to said resilient granular material, resisting removal by either aqueous solutions or abrasion from said projectiles;

at least one first additive, wherein said first additive chemically stabilizes at least said hydrated SAP gel, and wherein said first additive facilitates maintaining the pH of at least said hydrated SAP gel at above about 4.5, and wherein said first additive forms a passive coating on metallic particles introduced to said stable fire retardant mixture;

at least one second additive, wherein said second additive at least reduces said leaching of heavy metals, and wherein said first and second additives remain as powdery solids in said stable fire retardant mixture, and wherein at least one of said first and second additives at least prevent the leaching of phosphate, and wherein at least one of said first and second additives retards the growth of mold and bacteria, and wherein said first and second additives are intimately mixed with said first interim mixture to yield said stable fire retardant mixture.

2. The stable fire resistant mixture according to claim 1, in which said resilient granular material is selected from the group consisting of rubber chunks, wood chips, plastic scrap, and any combination thereof.

3. The stable fire resistant mixture according to claim 1, in which said hydrated SAP gel is selected from the group consisting of sodium acrylate, potassium acrylate, sodium acrylamide, potassium acrylamide, sodium carboxylate, potassium carboxylate, and any combination thereof, wherein each said additive is added to said hydrated SAP gel in the ratio of about 5 to about 10 parts by weight per 100 parts by weight of said hydrated SAP gel, and wherein addition of each said additive results in at least a saturated solution of each additive in said mixture, and wherein the concentration of each said additive is such that said concentration does not adversely affect the water absorbance of said hydrated SAP gel.

4. The stable fire resistant mixture according to claim 1, in which said first additive is selected from the group consisting of phosphates, carbonates, hydroxides, silicates, bicarbonates, and any combination thereof.

5. The stable fire resistant mixture according to claim 1, said first additive employed in sufficient quantity to adjust the pH of said hydrated SAP gel in a range of about 8 to about 12.

6. The stable fire resistant mixture according to claim 1, in which said second additive is selected from the group consisting of calcium carbonate, calcium phosphate, aluminum hydroxide and combinations thereof.

7. A backstop for decelerating and trapping projectiles traveling along a line of fire, said backstop at least comprising:

a support structure having an upper surface, said upper surface having at least one segment inclined with respect to the line of fire; and a stable fire retardant mixture for decelerating and trapping projectiles comprising at least in part heavy metals, said mixture at least reducing leaching of said heavy metals, said mixture comprising:

resilient granular material selected from the group consisting of rubber chunks, wood chips, plastic scrap, and combinations thereof;

hydrated super absorbent polymer (SAP) gel, wherein said hydrated SAP gel is intimately mixed with said resilient granular material to yield a first interim mixture, and wherein said hydrated SAP gel adheres to said resilient granular material, resisting removal by either aqueous solutions or abrasion from said projectiles;

at least one first additive selected from the group consisting of phosphates, carbonates, hydroxides, silicates, bicarbonates, and combinations thereof, wherein said first additive chemically stabilizes at least said hydrated SAP gel, and wherein said first additive facilitates maintaining the pH of said hydrated SAP gel at above about 4.5; and at least one second additive, wherein said second additive at least reduces said leaching of heavy metals, and wherein said first and second additives are intimately mixed with said first interim mixture to yield said stable fire retardant mixture, and wherein said stable fire retardant mixture is disposed on at least a portion of said upper surface, and wherein said backstop reduces ricochets and requires reduced maintenance compared to conventional backstops.

8. The backstop according to claim 7, in which said first additive is selected from the group consisting of phosphates, carbonates, hydroxides, silicates, bicarbonates, and any combination thereof, wherein said first additive is employed to adjust the pH of at least said hydrated SAP gel in a range of about 8 to about 12.

9. The backstop according to claim 7, wherein said support structure further comprises at least one sidewall.

10. The backstop according to claim 9, wherein said support structure further comprises opposing first and second sidewalls.

11. The backstop according to claim 7, wherein said support structure further comprises a back wall.

12. The backstop according to claim 7, wherein said support structure further comprises a toe block.

13. The backstop according to claim 7, wherein said support structure further comprises a shock-absorbing, foamed, fiber-reinforced concrete enclosure surrounding at least a portion of said stable fire resistant mixture.

14. The backstop according to claim 7, in which said second additive is selected from the group consisting of calcium carbonate, calcium phosphate, aluminum hydroxide and combinations thereof.

15. The backstop according to claim 7, in which said resilient granular material is selected from the group consisting of rubber chunks, wood chips, plastic scrap, and any combination thereof.

16. The backstop according to claim 7, wherein said hydrated SAP gel is selected from the group consisting of sodium acrylate, potassium acrylate, sodium carboxylate, potassium acrylamide, sodium carboxylate, potassium carboxylate, and any combination thereof.

17. The backstop according to claim 7, wherein said inclined segment is inclined by an angle less than or equal to an angle of repose of said stable fire retardant mixture.

18. A method of forming a stable fire retardant mixture for decelerating and trapping projectiles, said mixture further reducing leaching of said heavy metals, comprising:

providing resilient granular material;

providing hydrated super absorbent polymer (SAP);

intimately mixing said hydrated SAP gel with said resilient granular material to establish a first interim mixture, wherein said hydrated SAP gel adheres to said resilient granular material;

providing at least one first additive, wherein said first additive chemically stabilizes at least said hydrated SAP gel, and wherein said first additive facilitates maintaining the pH of said hydrated SAP gel at above about 4.5;

providing at least one second additive, wherein said second additive reacts with said projectiles to at least reduce said leaching of said heavy metals; and intimately mixing said first and said second additives into said first interim mixture to establish said stable fire retardant mixture.

19. The method according to claim 18, selecting resilient granular material from the group consisting of rubber chunks, wood chips, plastic scrap, and any combination thereof.

20. The method according to claim 18, selecting said hydrated SAP gel from the group consisting of sodium acrylate, potassium acrylate, sodium acrylamide, potassium acrylamide, sodium carboxylate, potassium carboxylate, and any combination thereof.

21. The method according to claim 18, said first additive from the group consisting of phosphates, carbonates, hydroxides, silicates, bicarbonates, and any combination thereof, wherein said first additive is employed to at least adjust the pH of said hydrated SAP gel in a range of about 8 to about 12.

22. The method according to claim 18, said second additive from the group consisting of calcium carbonate, calcium phosphate, aluminum hydroxide and combinations thereof.

23. A method of fabricating a backstop for decelerating and trapping projectiles traveling along a line of fire, comprising:

providing a support structure having an upper surface, at least one segment of the upper surface being inclined with respect to the line of fire;

providing a stable fire retardant mixture for decelerating and trapping projectiles comprising at least in part heavy metals, said stable fire retardant mixture at least reducing leaching of said heavy metals, said stable fire retardant mixture comprising:

resilient granular material;

hydrated super absorbent polymer (SAP) gel, wherein said hydrated SAP gel is intimately mixed with said resilient granular material to yield a first interim mixture;

at least one first additive, wherein said first additive chemically stabilizes at least said hydrated SAP gel, and wherein said first additive facilitates maintaining the pH of said hydrated SAP gel at above about 4.5; and at least one second additive, wherein said second additive at least reduces said leaching of heavy metals;

intimately mixing said first and second additives with said first interim mixture to yield said stable fire retardant mixture; and disposing the stable fire retardant mixture on at least a portion of the upper surface of the support structure, wherein said backstop reduces ricochets and requires reduced maintenance compared to conventional backstops.

24. The method according to claim 23, further comprising enclosing at least a portion of the stable fire retardant mixture.

25. The method according to claim 23, further comprising enclosing at least a portion of the stable fire retardant mixture within a shock-absorbing, foamed, fiber-reinforced concrete enclosure.

26. The method according to claim 23, further comprising selecting said first additive from the group consisting of phosphates, carbonates, hydroxides, silicates, bicarbonates, and any combination thereof, wherein said first additive is employed to at least adjust the pH of said hydrated SAP gel in a range of about 8 to about 12.

27. The method according to claim 23, selecting said second additive from the group consisting of calcium carbonate, calcium phosphate, aluminum hydroxide and combinations thereof.

28. The method according to claim 23, selecting said hydrated SAP gel from the group consisting of sodium acrylate, potassium acrylate, sodium acrylamide, potassium acrylamide, sodium carboxylate, potassium carboxylate, and any combination thereof.

29. The method according to claim 23, selecting said resilient granular material from the group consisting of rubber chunks, wood chips, plastic scrap, and any combination thereof.

* * * * *